US007219682B2

(12) United States Patent
Agnew et al.

(10) Patent No.: US 7,219,682 B2
(45) Date of Patent: May 22, 2007

(54) LIQUID DISPLACEMENT SHUTTLE SYSTEM AND METHOD

(75) Inventors: Patrick A. Agnew, Calgary (CA); Ian Morris, Cambell River (CA); Bruce Hall, Katy, TX (US)

(73) Assignee: SeaOne Maritime Corp., Houston, TX (US)

( * ) Notice: Subject to any disclaimer, the term of this patent is extended or adjusted under 35 U.S.C. 154(b) by 442 days.

(21) Appl. No.: 10/928,718

(22) Filed: Aug. 26, 2004

(65) Prior Publication Data

US 2006/0042692 A1 Mar. 2, 2006

(51) Int. Cl.
*F17D 1/00* (2006.01)

(52) U.S. Cl. ..... 137/1; 137/263; 137/565.01

(58) Field of Classification Search ..... 137/263, 137/255, 565.01, 1
See application file for complete search history.

(56) References Cited

U.S. PATENT DOCUMENTS

| | | | | |
|---|---|---|---|---|
| 2,497,793 | A | 2/1950 | Ransome | |
| 2,550,844 | A | 5/1951 | Meiller et al. | |
| 3,232,725 | A | 2/1966 | Secord et al. | |
| 3,256,709 | A | 6/1966 | Stepleton | |
| 3,298,805 | A | 1/1967 | Secord et al. | |
| 3,407,613 | A | 10/1968 | Muller et al. | |
| 4,010,622 | A | 3/1977 | Etter | |
| 4,024,720 | A | 5/1977 | Dimentberg, et al. | |
| 4,139,019 | A | 2/1979 | Bresie et al. | |
| 4,203,742 | A | 5/1980 | Agnihotri | |
| 4,622,053 | A | 11/1986 | Tomlinson et al. | |
| 4,660,588 | A * | 4/1987 | Skraba | 137/263 |
| 5,315,054 | A | 5/1994 | Teel | |
| 6,201,163 | B1 | 3/2001 | Morris et al. | |
| 6,217,626 | B1 | 4/2001 | Morris et al. | |
| 6,260,501 | B1 | 7/2001 | Agnew | |
| 6,339,996 | B1 | 1/2002 | Campbell | |
| 6,449,961 | B1 | 9/2002 | Korsgaard | |
| 6,584,780 | B2 | 7/2003 | Hibino et al. | |
| 6,584,781 | B2 | 7/2003 | Bishop et al. | |
| 6,613,126 | B2 | 9/2003 | Tange et al. | |
| 6,655,155 | B2 * | 12/2003 | Bishop | 62/45.1 |

FOREIGN PATENT DOCUMENTS

| | | |
|---|---|---|
| GB | 1415729 | 11/1975 |

* cited by examiner

*Primary Examiner*—Kevin Lee
(74) *Attorney, Agent, or Firm*—Orrick, Herrington & Sutcliffe LLP

(57) ABSTRACT

A multi-vessel gas storage system and liquid displacement shuttle system that utilizes a liquid-piston shuttled to alternate reservoirs and tank banks to evacuate stored gas or other fluids from storage vessels. Preferably, the gas storage and fluid displacement shuttle system includes multiple pressure storage vessels or tanks arranged in tank banks that are preferably coupled in parallel at one end to a high pressure gas manifold to exhaust the stored gas or other fluids from the vessels and coupled in parallel at another end to separate fluid shuttle circuits. The fluid shuttle circuits include cross-piped fluid fill and drain manifolds that are fluidly linked through interposing reservoirs and pumps. In operation, the stored gas or other fluids are evacuated from the storage vessels by shuttling the volume of displacement liquid between alternating banks of storage tanks and reservoirs with alternating pumps.

23 Claims, 6 Drawing Sheets

LIQUID DISPLACEMENT SHUTTLE SYSTEM AND METHOD

FIELD OF THE INVENTION

The invention relates generally to the storage and transport of compressed gas and, more particularly, to a fluid displacement shuttle system and method that facilitates loading and unloading compressed gas or other fluids in multiple vessel storage systems.

BACKGROUND INFORMATION

The gains in storage capacity from increasing levels of pressure under which compressed gasses are held come at the cost of discharging large volumes in a desired short period of time. Many gas storage systems use multiple pressure vessels interconnected to manifolds. Discharging from a high pressure storage vessel (at for example 3500 psig) to a receiving terminal (rated for example at 1200 psig) can be accomplished by pressure equalization in a first stage of evacuation. The gas remaining in the container, which is now at the lower terminal pressure level, undergoes a second stage of evacuation by connection to a drawdown compression or low pressure manifold. As a result, the flow of compressed gas transported in multiple assemblies of pressure vessels at high pressures is frequently subject to a bottleneck of prolonged loading and unloading times.

In seeking to improve the evacuation of the contents of these storage vessels, proposed systems, such as that disclosed in Bishop U.S. Pat. No. 6,655,155, seek to displace the gas under full holding pressure using a displacement liquid in a manner similar to that used to move product from underground storage caverns. Given the gross volume of all storage containers, it is possible to purge all interconnected vessels by simultaneous displacement with an equal volume of liquid. However, such an equal volume would require a large shore mounted supply with recycle facilities in the case of marine transportation. Such a volume would be impractical to carry on board a ship and require inordinate amounts of motive power. In response to this problem, Bishop advocates a staged tier displacement system designed into the ship reducing a 200,000 bbls initial on board storage need to 50,000 bbls of on board storage.

Accordingly, it would be desirable to provide an improved evacuation system and method that facilitates the reduction of the amount of displacement liquid used for unloading compressed gas from a multi-vessel storage system and to improve evacuation times by displacement of the compressed gas contents in their entirety from the storage vessels.

SUMMARY

The present invention is directed to a multi-vessel storage and fluid or liquid displacement shuttle system, which utilizes a liquid-piston shuttled to alternate vessels to evacuate stored product such as compressed or high pressure gas or other fluids from the storage vessels. In a preferred embodiment, the gas storage and fluid or liquid displacement shuttle system includes multiple storage vessels or tanks, or banks of vessels or tanks, that are preferably coupled in parallel at one end to a discharge manifold such as a high pressure gas manifold to exhaust the stored product from the vessels and coupled in parallel at another end to separate fluid shuttle circuits. The fluid shuttle circuits include cross-piped fluid fill and drain manifolds that are fluidly linked through interposing reservoirs and pumps. In operation, the stored product is evacuated from the storage vessels by shuttling the volume of displacement liquid between alternating banks of storage tanks and reservoirs with alternating pumps. Alternatively, a single pump and storage (reservoir) system could also be used with a more complex control system when a greater storage volume is required Other systems, methods, features and advantages of the invention will be or will become apparent to one with skill in the art upon examination of the following figures and detailed description.

BRIEF DESCRIPTION OF THE FIGURES

The details of the invention, including fabrication, structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

DETAILED DESCRIPTION

Turning to the figures, a multi-vessel storage system of the present invention is shown to include a liquid displacement shuttle system. In the liquid displacement shuttle system, use is made of a liquid-piston which is then shuttled to alternate reservoirs for reuse in the next storage vessel or tank in the assembly. In tight spaces, the storage space saved can be used for stored product, and not displacement liquid. Although the liquid displacement shuttle system is depicted and discussed in regard to its use in a compressed or high pressure gas storage system, it is not restricted to use just with compressed gas, and one of skill in the art would understand the liquid displacement shuttle principal being equally suited to moving compatible stored liquids or fluids.

The present invention reduces the volume of displacement liquid to a fraction of a storage system's volume by shuttling the volume of displacement liquid between alternating storage tanks or banks of storage tanks and one or more reservoirs using one or more pumps. Multiple sets of shuttle links along the length of a ship could operate simultaneously, while maintaining a lower level of displacement liquid than advocated by conventional methods (see, e.g., Bishop). As depicted in the figures, the gas storage and liquid displacement shuttle system preferably operates with vertical storage vessels or tanks clustered to a common manifold collector valve, but can operate with horizontally disposed vessels or tanks as well.

Figure 1:
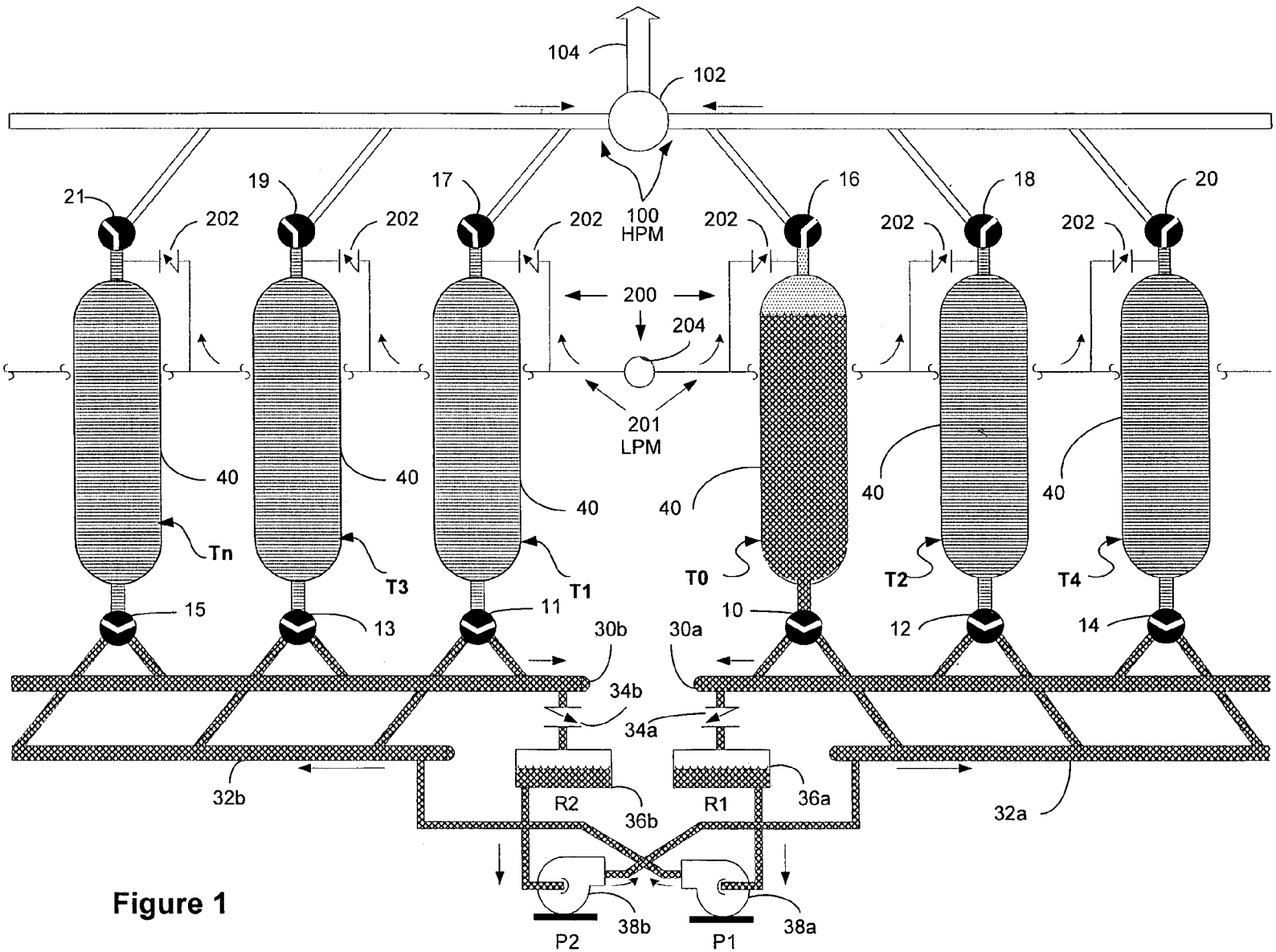
FIG. 1 depicts a multiple pressure vessel storage and fluid displacement shuttle system in accordance with the present invention prior to the gas evacuation cycle.

In a preferred embodiment, as depicted in FIG. 1, the gas storage and fluid displacement shuttle system includes multiple pressure storage vessels or tanks 40 arranged in tank banks T0, T1, T2, T3, T4, . . . Tn preferably comprising the same number of equally sized vessels 40 such that the gross volume of each tank bank is equal. The vessels 40 are preferably coupled in parallel adjacent their vessel tops to a discharge or high pressure gas manifold (HPM) 100 to exhaust stored gas or other fluids from the vessels 40 and coupled in parallel adjacent their vessel bottoms to separate fluid shuttle circuits. The fluid shuttle circuits include cross-piped fluid fill and drain manifolds 30*a*, 30*b*, 32*a* and 32*b* that are fluidly linked through interposing reservoirs 36*a* and 36*b* and pumps 38*a* and 38*b*. As depicted, the vessels 40 are coupled through multi-position discharge gas valves 16, 17, 18, 19, 20 and 21 to the HPM 100, which includes a collector valve 102 with a gas delivery outlet 104. As depicted, the vessels 40 in a first set of the even numbered tank banks T0, T2, and T4 are coupled through multi-position shuttle fluid valves 10, 12 and 14 to a first fluid drain manifold 30*a* and a first fluid fill manifold 32*a* while the vessels 40 in a second set of the odd numbered tank banks T1, T3, and Tn are coupled through multi-position shuttle fluid valves 11, 13 and 15 to a second fluid drain manifold 30*b* and a second fluid fill manifold 32*b*. The first drain manifold 30*a* is coupled to a first reservoir 36*a*, which in turn is coupled to a first pump 38*a*, which in turn is coupled to the second fill manifold 32*b*, thus fluidly linking the first drain manifold 30*a* to the second fill manifold 32*b* and forming the first fluid shuttle circuit. Similarly, the second drain manifold 30*b* is coupled to a second reservoir 36*b*, which in turn is coupled to a second pump 38*b*, which in turn is coupled to the first fill manifold 32*a*, thus fluidly linking the second drain manifold 30*b* to the first fill manifold 32*a* and forming the second fluid shuttle circuit. Interposing the first drain manifold 30*a* and first reservoir 36*a*, and the second drain manifold 30*b* and second reservoir 36*b*, respectively, are first and second one-way flow check valves 34*a* and 34*b*. The multi-position shuttle fluid valves 10, 11, 12, 13, 14 and 15, first and second fluid drain manifolds 30*a* and 30*b*, first and second fluid fill manifolds 32*a* and 32*b*, first and second reservoirs 36*a* and 36*b*, first and second pumps 38*a* and 38*b*, first and second flow check valves 34*a* and 34*b* and a low pressure gas displacement system 200 form the liquid displacement shuttle system of the present invention. The low pressure gas displacement system 200 includes a low pressure gas manifold ("LPM") 201, which includes a collector valve 204 and is coupled to the vessels 40 through one-way low pressure flow check valves 202.

Preferably, the multi position valves are low pressure gas actuated, control logic valves that may be activated by a stroke count on the pumps or tank level detection depending on physical layout of the system. The actuator exhaust gas is preferably routed to gas expansion heaters.

As depicted, the tanks, reservoirs and manifolds are preferably interconnected through small diameter piping, tubing or the like. The one way fluid flow check valves 34*a* and 34*b* permit displacement liquid from the drain manifolds 30*a* and 30*b* to drain into the reservoirs 36*a* and 36*b*, but not back into the manifolds 30*a* and 30*b* from the reservoirs 36*a* and 36*b*, while the one way gas flow check valves 202 permit low pressure blanket gas to fill and equalize pressure in evacuated spaces within the vessels 40, but not back into the LPM 201 from the vessels 40. The blanket gas may be methane, ethane, butane, propane and the like, or mixtures thereof as apropriate to the stored product.

The mode of operation is described below in conjunction with FIGS. 1 through 6. The valve sequence and activity within each tank bank, as depicted in each figure, are listed in Table 1.

Turning to FIG. 1, the system is depicted in a state prior to the gas displacement or evacuation cycle to unload the stored gas, with one tank bank, represented by tank T0, initially filled with a non reactive displacement liquid such as saturated natural gas liquid (NGL), compatible solvent gas, and the like, or mixtures thereof. The volume of displacement liquid in tank T0 is preferably substantially equivalent to the volume of gas stored in each individual tank bank. Preferably, the fluid shuttle circuits are also filled displacement liquid. The space above the displacement liquid in tank T0 is preferably filled with low pressure gas from the LPM 201. The remaining tanks or vessels 40 in tank banks T1, T2, T3, T4 . . . Tn are all filled with high pressure gas ("HPG"). (Reference to "tank T0, tank T1, . . . tank Tn" in the remaining discussion will be understood by one skilled in the art to be referring to the specified tank bank T0, T1, . . . etc. As would be further understood by one skilled in the art, the tank banks may be configured to include a single vessel or an equal number of a plurality of vessels).

Figure 2:
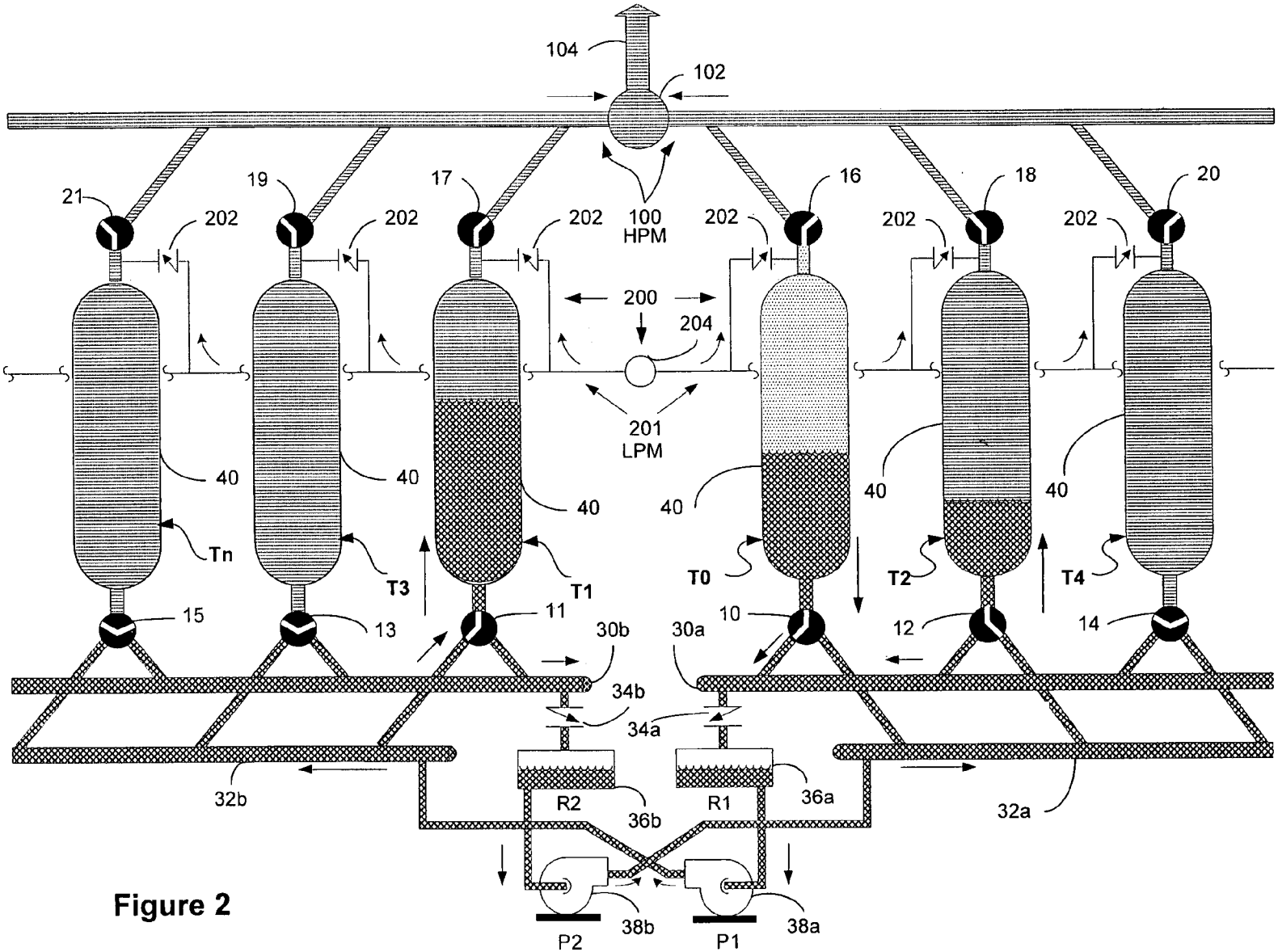
FIG. 2 depicts the system of the present invention in an initial phase of the gas evacuation cycle.

As depicted in FIG. 2, the unloading process or gas evacuation cycle is initialized by rotating the shuttle valve 10 of tank T0 to a first opened position coupling tank T0 to the first drain manifold 30*a* of the first fluid shuttle circuit. The displacement liquid drains from tank T0 into the first drain manifold 30*a* feeding the first reservoir 36*a*, which in turn feeds the first pump 38*a*, as low pressure gas from the LPM 201 flows through the check valve 202 into tank T0 to fill and equalize pressure in the evacuated space above the displacement liquid. The first pump 38, which is coupled to odd numbered tanks starting with tank T1, pumps displacement liquid into the second fill manifold 32*b* and on into tank T1 which is coupled to the second fill manifold 32*b* with its shuttle fluid valve 11 rotated to a first opened position permitting displacement liquid, which acts as a liquid piston, to push HPG out of tank T1 through the gas discharge valve 17. The discharge valve 17 is rotated to an opened position allowing gas to feed into the HPM 100 from where it is delivered through the gas outlet 104 to expansion and heating facilities or to on shore storage.

Tank T2, which is coupled to the first fill manifold 32*a* of the second fluid shuttle circuit with its shuttle valve 12 rotated to a first opened position, is shown beginning its HPG evacuation cycle being fed displacement liquid from the second pump 38*b* and second reservoir 36*b* through the first fill manifold 32*a* and its open shuttle valve 12. The HPG is vented to the HPM 100 through the open discharge valve 18. As depicted in FIG. 2 and Table 1, the remaining tanks wait in isolated mode.

Figure 3:
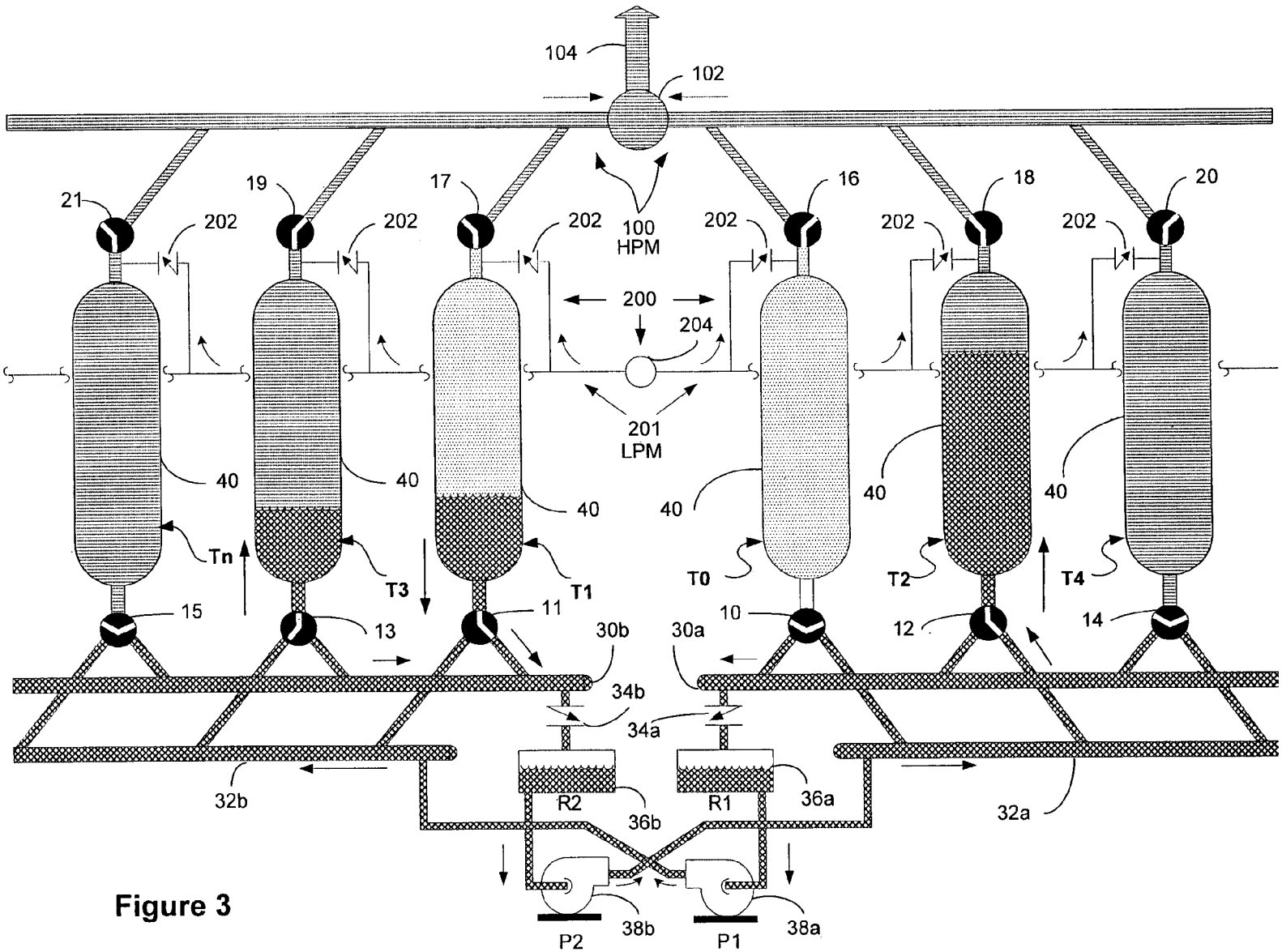
FIG. 3 depicts the system of the present invention in a subsequent phase of the gas evacuation cycle.

FIG. 3 shows tank T0 emptied of displacement liquid and filled with low pressure gas. The shuttle fluid valve 10 and gas discharge valve 16 of tank T0 are closed to isolate tank T0 from active operations. Tank T1 has been evacuated of HPG, its gas discharge valve 17 is closed and its shuttle valve 11 has been rotated to a second opened position to couple tank T1 to the second drain manifold 30*b* of the second fluid shuttle circuit to drain displacement liquid into the second drain manifold 30*b* and on into the second reservoir 36*b* as low pressure gas from the LPM 201 flows through the check valve 202 into tank T1 to fill and equalize pressure in the evacuated space above the displacement liquid. The second reservoir 36*b* feeds the second pump 38*b* which in turn feeds the first fill manifold 32*a* and tank T2 which is coupled to the first fill manifold 32*a* with its shuttle 12 open to a first opened position. Displacement liquid fills tank T2 displacing HPG from tank T2 through its gas discharge valve 18 which is rotated to an opened position coupling tank T2 to the HPM 100.

Tank T3, which is coupled to the second fill manifold 32*a* with its shuttle valve 13 rotated to a first opened position, is shown beginning its HPG evacuation cycle being fed displacement liquid from the first pump 38*a* and first reservoir 36*a* through the second fill manifold 32*a* and its open shuttle valve 13. The HPG is vented to the HPM 100 through its open discharge valve 19. As depicted in FIG. 3 and Table 1, the remaining tanks wait in isolated mode.

Figure 4:
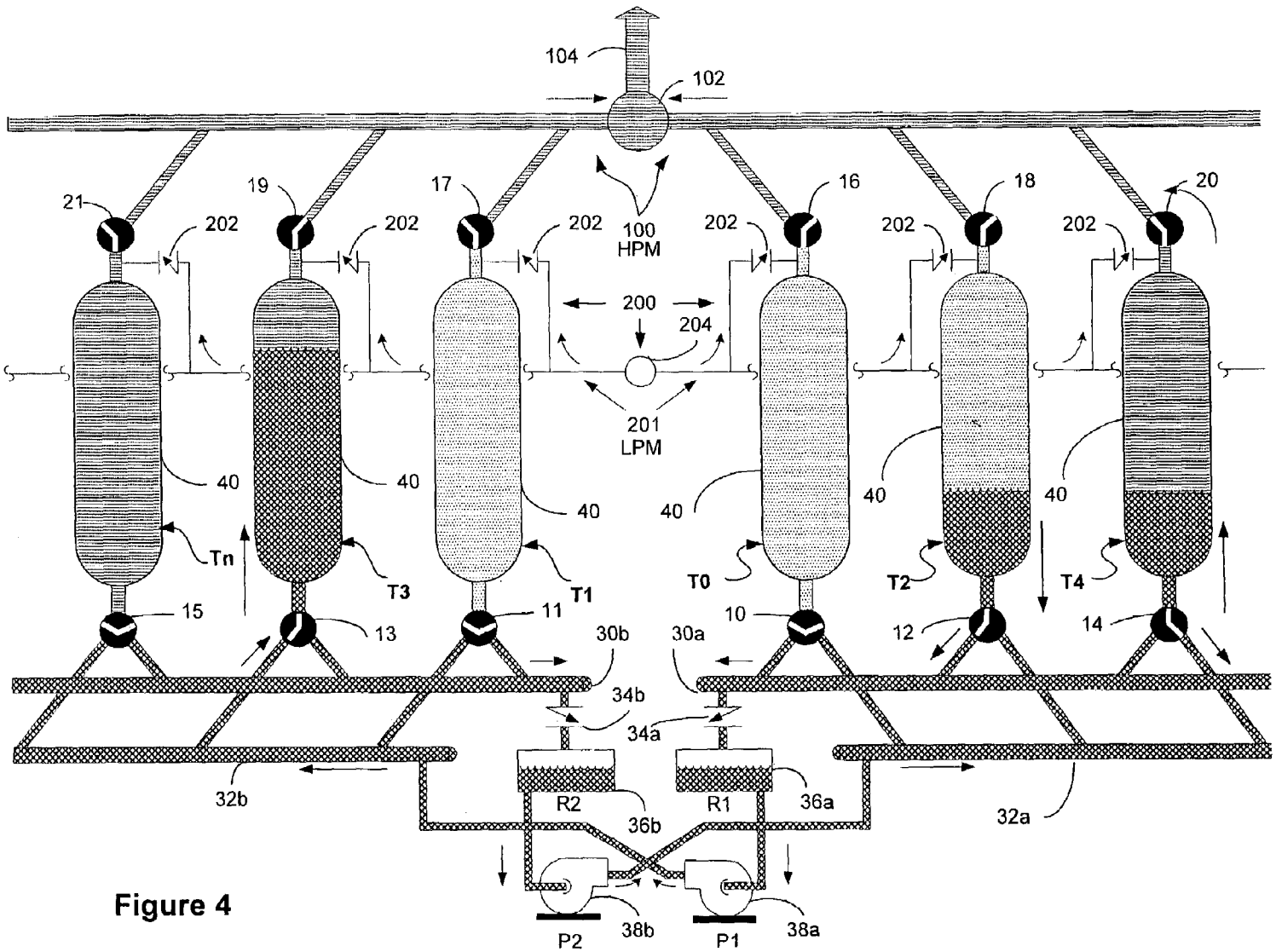
FIG. 4 depicts the system of the present invention in a subsequent phase of the gas evacuation cycle.

In FIG. 4, tanks T0 and T1 are shown empty of displacement liquid and with their valves 10, 11, 16 and 17 closed isolating their low pressure gas contents. Tank T2 is shown nearing drainage completion of its displacement liquid to the first reservoir 36*a* with its gas discharge valve 18 closed and its shuttle valve 12 open to the first drain manifold 30*a*. Tank 3 is shown with its shuttle valve 13 open to the second fill manifold 32*b* and being fed displacement liquid from the first pump 38*a*, and in the final stage of venting HPG through its gas discharge valve 19 to the HPM 100.

Tank T4, which is coupled to the first fill manifold 32*a* with its shuttle valve 14 rotated to a first opened position, is shown beginning its HPG evacuation cycle being fed displacement liquid from the second pump 38*b* and second reservoir 36*b* through the first fill manifold 32*a* and its open shuttle valve 14. The HPG is vented to the HPM 100 through its open discharge valve 20. As depicted in FIG. 4 and Table 1, the remaining tanks wait in isolated mode.

Figure 5:
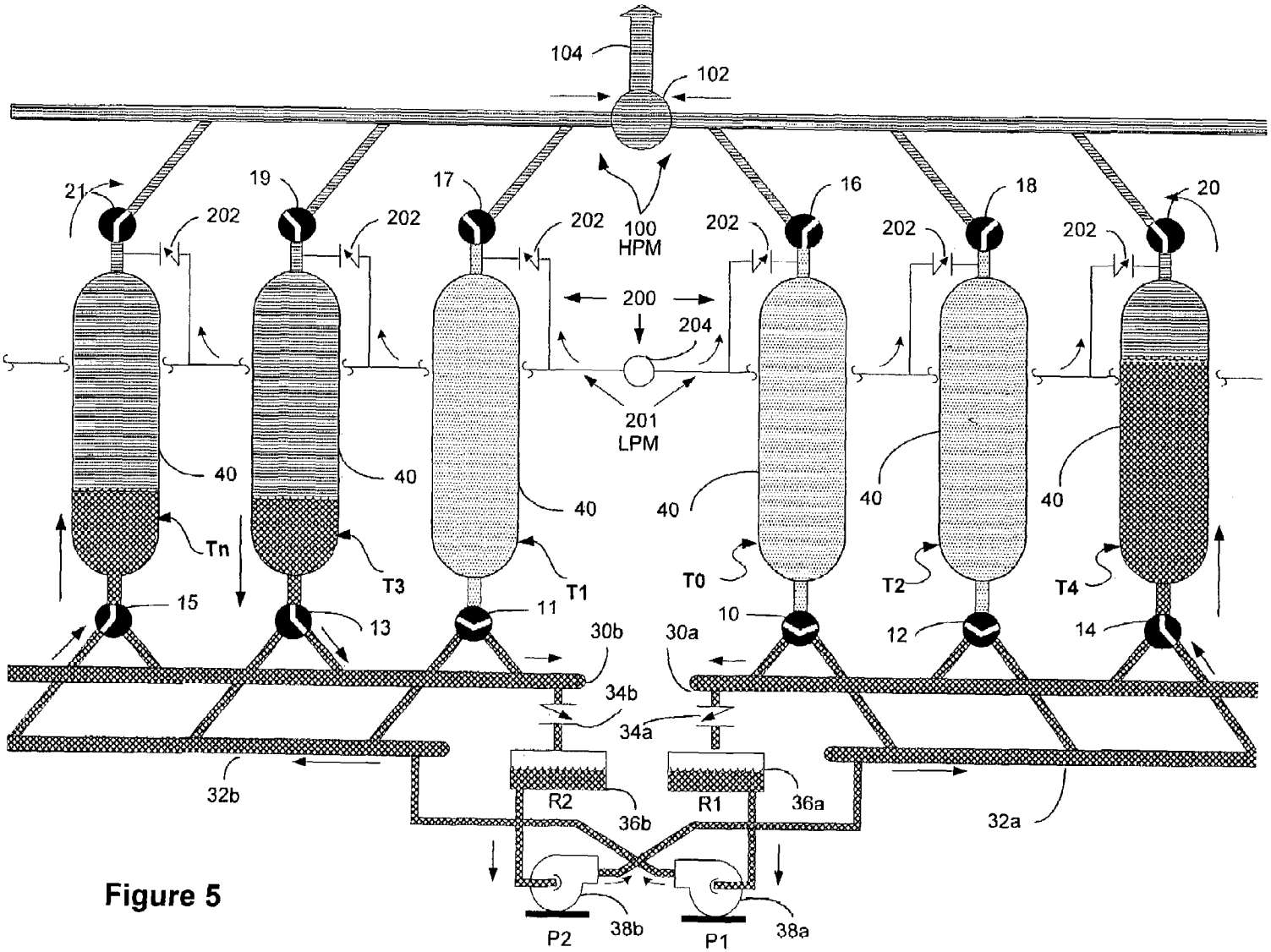
FIG. 5 depicts the system of the present invention in a subsequent phase of the gas evacuation cycle.

Turning to FIG. 5, tanks T0, T1 and T2 are shown in displacement liquid emptied mode with their valves 10, 11, 12 16, 17 and 18 set in isolation positions isolating the low pressure gas contents of T0, T1 and T2. Tank T3, which has switched to fluid drain mode, is shown with its gas discharge valve 19 closed and its shuttle valve 13 opened to the second drain manifold 30*b* to drain displacement liquid into the second reservoir 36*b*. Tank T4 is shown approaching the final phase of displacing HPG into the HPM 100 through its open gas discharge valve 20 with displacement liquid being fed from the second pump 38*b* to the first fill manifold 32*a* and through its shuttle valve 14 which is opened to the first fill manifold 32*a*.

A sixth tank bank, tank Tn, which is coupled to the second fill manifold 32*a* with its shuttle valve 15 rotated to a first opened position, is shown beginning its HPG evacuation cycle being fed displacement liquid from the first pump 38*a* and first reservoir 36*a* through the second fill manifold 32*a* and its open shuttle valve 15. The HPG is vented to the HPM 100 through its open discharge valve 21. The designation of the fifth tank bank as tank Tn will be understood by one skilled in the art to indicate that the system is expandable beyond the number of tank banks depicted in the figures.

Figure 6:
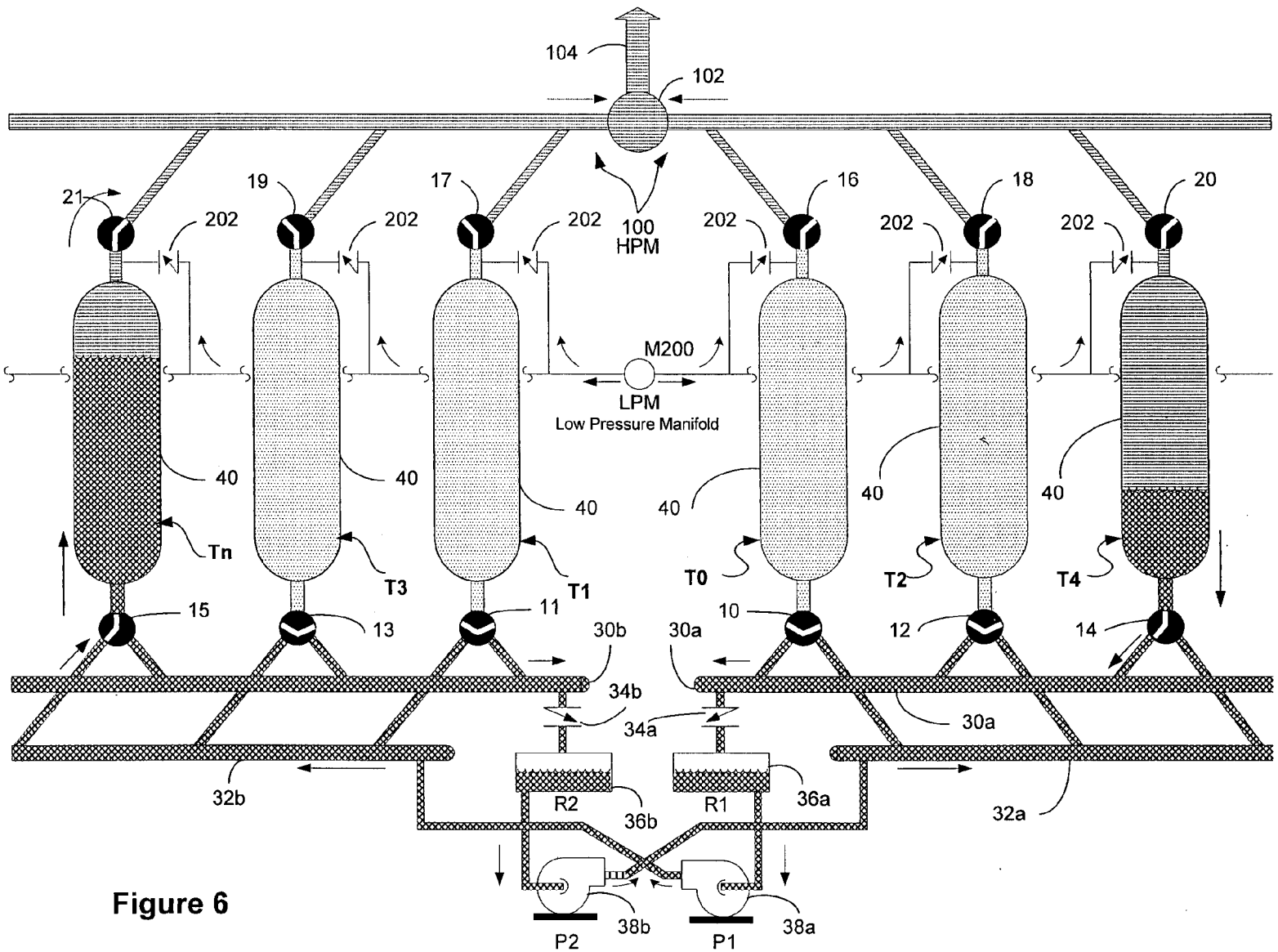
FIG. 6 depicts the system of the present invention in a subsequent phase of the gas evacuation cycle.

In FIG. 6, the end phase of this sequence is shown with tanks T0 through T3 emptied of displacement liquid and filled with low pressure gas with their valves 10, 11, 12, 13, 16, 17, 18 and 19 set in isolation mode isolating their low pressure gas contents. Tank T4, which has switched to fluid drain mode, is shown in final drain mode with its gas discharge valve 20 closed and its shuttle valve 14 opened to the first drain manifold 30*a* to drain displacement liquid into the first reservoir 36*a*. The sixth tank bank, tank Tn, is shown approaching the final phase of displacing HPG into the HPM 100 through its open gas discharge valve 21 with displacement liquid being fed from the first pump 38*a* to the second fill manifold 32*b* and through its shuttle valve 15 which is opened to the second fill manifold 32*b*. For systems greater in size than that depicted in the figures, the second pump 38*b* would feed displacement liquid to the next tank bank not shown in the figures or Table 1.

The above illustrates how through cross piping the initial batch of displacement liquid from tank T0 can be transferred through all of the tank banks, alternating between different sets of tank banks and shuttling between the reservoirs. The sequence as described above can continue through many more tank banks or vessels within the desired discharge time. The saving in storage space for displacement liquid resulting from this shuttle system is now useable for additional HPG storage.

Multi port valving used in the forgoing description can also be replaced by single port valves according to prevailing design codes.

TABLE 1

| | Sequence of Displacement liquid Shuttle through Pumps & tanks | | | | | |
|---|---|---|---|---|---|---|
| | tank T0 | tank T1 | tank T2 | tank T3 | tank T4 | Tank Tn |
| FIG. 1 | | | | | | |
| Gas Valve | Closed | Closed | Closed | Closed | Closed | Closed |
| Fluid Valve | Closed | Closed | Closed | Closed | Closed | Closed |
| Contents/ Status | Disp Fluid Stored | HP Gas Stored | HP Gas Stored | HP Gas Stored | HP Gas Stored | HP Gas Stored |
| FIG. 2 | | | | | | |
| Gas Valve | Closed | Open to HPM | Open to HPM | Closed | Closed | Closed |
| Fluid Valve | Open to Res R1 | Open to Pump P1 | Open to Pump P2 | Closed | Closed | Closed |
| Contents/ Status | Disp Fluid Emptying to Res R1 | 30% HP Gas Displacement | 70% HP Gas Displacement | HP Gas | HP Gas | HP Gas |
| FIG. 3 | | | | | | |
| Gas Valve | Closed | Closed | Open to HPM | Open to HPM | Closed | Closed |
| Fluid Valve | Closed | Open to Res R2 | Open to Pump P2 | Open to Pump P1 | Closed | Closed |

TABLE 1-continued

| Sequence of Displacement liquid Shuttle through Pumps & tanks | | | | | | |
|---|---|---|---|---|---|---|
| | tank T0 | tank T1 | tank T2 | tank T3 | tank T4 | Tank Tn |
| Contents/ Status FIG. 4 | LP Gas/ Liq Unloaded | 30% Disp Fluid Emptying to R2 | 30% HP Gas Displacement | 70% HP Gas Displacement | HP Gas Stored | HP Gas Stored |
| Gas Valve | Closed | Closed | Closed | Open to HPM | Open to HPM | Closed |
| Fluid Valve | Closed | Closed | Open to Res R1 | Open to Pump P1 | Open to Pump P2 | Closed |
| Contents/ Status FIG. 5 | LP Gas/ Liq Unloaded | LP Gas/ Liq Unloaded | Disp Fluid Emptying to R1 | 30% HP Gas Displacement | 70% HP Gas Displacement | HP Gas Stored |
| Gas Valve | Closed | Closed | Closed | Closed | Open to HPM | Open to HPM |
| Fluid Valve | Closed | Closed | Closed | Open to Res R2 | Open to Pump P2 | Open to Pump P1 |
| Contents/ Status FIG. 6 | LP Gas/ Liq Unloaded | LP Gas/ Liq Unloaded | LP Gas/ Liq Unloaded | 30% Disp Fluid Emptying to R2 | 30% HP Gas Displacement | 70% HP Gas Displacement |
| Gas Valve | Closed | Closed | Closed | Closed | Closed | Open to HPM |
| Fluid Valve | Closed | Closed | Closed | Closed | Open to Res R1 | Open to Pump P1 |
| Contents/ Status | LP Gas/ Liq Unloaded | LP Gas/ Liq Unloaded | LP Gas/ Liq Unloaded | LP Gas/ Liq Unloaded | 30% Disp Fluid Emptying to R1 | 30% HP Gas Displacement |

In the foregoing specification, the invention has been described with reference to specific embodiments thereof. It will, however, be evident that various modifications and changes may be made thereto without departing from the broader spirit and scope of the invention. For example, the reader is to understand that the specific ordering and combination of process actions shown in the process flow diagrams described herein is merely illustrative, unless otherwise stated, and the invention can be performed using different or additional process actions, or a different combination or ordering of process actions. As another example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed is:

1. A fluid storage and liquid displacement shuttle system comprising a plurality of tank banks each comprising a plurality of storage vessels, a discharge manifold coupled to a first end of the plurality of storage vessels, a first fluid shuttle circuit coupled at a first end to a second end of the plurality of storage vessels in a first set of the plurality of tank banks and at a second end to a second end of the plurality of vessels in a second set of the plurality of tank banks, and a second fluid shuttle circuit coupled at a first end to the second end of the plurality of storage vessels in the second set of the plurality of tank banks and at a second end to the second end of the plurality of vessels in the first set of the plurality of tank banks, wherein one of the plurality of tank banks includes a displacement liquid stored in its plurality of storage vessels and the other of the plurality of tank banks includes a fluid stored in the plurality of vessels intended to be evacuated from the plurality of vessels when displaced by the displacement liquid.

2. The system of claim 1 further comprising a low pressure gas displacement system coupled to the plurality of vessels.

3. The system of claim 1 wherein the first fluid shuttle circuit comprises a first drain manifold coupled in parallel to the plurality of vessels of the first set of the plurality of tank banks, a first reservoir coupled to the first drain manifold, a first pump coupled to the first reservoir, and a first fill manifold coupled to the first pump and to the plurality of vessels of the second set of the plurality of tank banks.

4. The system of claim 3 wherein the first fluid shuttle circuit comprises a second drain manifold coupled in parallel to the plurality of vessels of the second set of the plurality of tank banks, a second reservoir coupled to the second drain manifold, a second pump coupled to the second reservoir, and a second fill manifold coupled to the second pump and to the plurality of vessels of the first set of the plurality of tank banks.

5. The system of claim 4 wherein first and second check valves, respectively, interpose the first and second reservoirs and first and second pumps, respectively.

6. The system of claim 1 wherein each of the plurality of vessels includes a multi-position shuttle valve positionable between a first position that fluidly isolates the vessel from the first and second fluid shuttle circuits, a second position that fluidly couples the vessel to the first fluid shuttle circuit, and a third position that fluidly couples the vessel to the second fluid shuttle circuit.

7. The system of claim 6 wherein each of the plurality of vessels includes a multi-position discharge valve positionable between a first position that fluidly isolates the vessel from the discharge manifold and a second position that fluidly couples the vessel to the discharge manifold.

8. The system of claim 1 wherein the stored fluid is a compressed gas.

9. The system of claim 1 wherein the displacement liquid is a non reactive liquid.

10. The system of claim 1 wherein the displacement liquid is natural gas liquid.

11. The system of claim 1 wherein the plurality of storage vessels are vertically aligned relative to one another along axes extending from the first end to the second end of each of the plurality of storage vessels.

12. The system of claim 1 wherein the plurality of storage vessel are coupled in parallel to the discharge manifold and the first and second fluid shuttle circuits.

13. A method of storing and distributing displacement liquid suited for the purging stored fluids contained in storage vessels, comprising the steps of storing a displacement liquid in a first set of storage vessels, storing a fluid to be purged in a second and third set of storage vessels, shuttling the displacement liquid from the first set of storage vessels to the second set of storage vessel, displacing the stored fluid in the second set of storage vessels with the displacement fluid, and purging the stored fluid from the second set of storage vessels.

14. The method of claim 13 further comprising the steps of shuttling the displacement liquid from the second set of storage vessels to the third set of storage vessel, displacing the stored fluid in the third set of storage vessels with the displacement fluid, and purging the stored fluid from the third set of storage vessels.

15. The method of claim 14 wherein the step of shuttling displacement liquid to the second set of storage vessels includes draining the displacement liquid from the first set of storage vessels into a first shuttle circuit, and passing the displacement liquid through the first shuttle circuit to the second set of storage vessels.

16. The method of claim 15 wherein the draining step includes feeding displacement liquid from the first set of vessels into a first manifold.

17. The method of claim 16 wherein the passing step includes feeding displacement liquid from the first manifold into a first reservoir, pumping displacement liquid from the first reservoir into a second manifold, and feeding displacement liquid from the second manifold into the second set of storage vessels.

18. The method of claim 17 wherein the step of purging the stored fluid from the second set of storage vessels includes exhausting gas from the second set of storage vessels.

19. The method of claim 18 wherein the step of shuttling displacement liquid to the third set of storage vessels includes draining the displacement liquid from the second set of storage vessels into a second shuttle circuit, and passing the displacement liquid through the second shuttle circuit to the third set of storage vessels.

20. The method of claim 19 wherein the draining step includes feeding displacement liquid from the second set of vessels into a third manifold.

21. The method of claim 20 wherein the passing step includes feeding displacement liquid from the second manifold into a second reservoir, pumping displacement liquid from the second reservoir into a fourth manifold, and feeding displacement liquid from the fourth manifold into the third set of storage vessels.

22. The method of claim 21 wherein the step of purging the stored fluid from the third set of storage vessels includes exhausting gas from the third set of storage vessels.

23. A method of storing and distributing displacement liquid suited for the purging stored gas contained in storage vessels, comprising the steps of storing a displacement liquid in a first set of storage vessels, storing a gas to be purged in a plurality of gas storage vessels, shuttling the displacement liquid from the first set of storage vessels to alternating sets of the plurality of gas storage vessels, and exhausting gas from the plurality of gas storage vessels.

* * * * *